United States Patent [19]

D'Haem et al.

[11] 4,044,625

[45] Aug. 30, 1977

[54] VIBRATION ISOLATING HAND GRIP FOR SHANK OF A PERCUSSIVE CHISEL

[75] Inventors: Marcel P. D'Haem, New Hartford; Wallis C. Axt, Holland Patent, both of N.Y.

[73] Assignee: Chicago Pneumatic Tool Company, New York, N.Y.

[21] Appl. No.: 701,536

[22] Filed: July 1, 1976

[51] Int. Cl.[2] ..... G05G 1/04

[52] U.S. Cl. ..... 74/558.5; 81/52.35; 173/162

[58] Field of Search ..... 81/52.35; 74/551.9, 74/558.5; 173/139, 162, DIG. 2; 16/116 R; 267/141; 181/36 A

[56] References Cited

U.S. PATENT DOCUMENTS

| | | | |
|---|---|---|---|
| 587,388 | 8/1897 | Conard | 74/551.9 |
| 599,131 | 2/1898 | King | 74/551.9 |
| 2,655,963 | 10/1953 | Dell | 173/162 X |

FOREIGN PATENT DOCUMENTS

| | | | |
|---|---|---|---|
| 2,520,261 | 11/1975 | Germany | 173/162 |
| 3,892 of | 1892 | United Kingdom | 74/551.9 |

*Primary Examiner*—James L. Jones, Jr.
*Attorney, Agent, or Firm*—Stephen J. Rudy

[57] ABSTRACT

A hand grip in the form of a sleeve unit having a body of elastomeric material provided with an internal cavity filled with a fluent material; and having an axial through hole adapted to slidably receive the shank of a chisel of a percussive tool, the hand grip adapted when manually squeezed to grip the shank of the chisel to allow insertion or removal of the shank from the tool, and adapted when grasped by the operator during operation of the tool to isolate the vibrations of the shank from the hand of the operator.

7 Claims, 6 Drawing Figures

FIG. 6
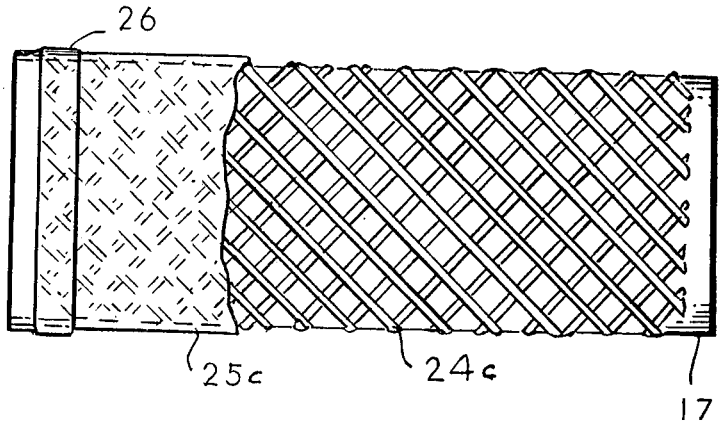
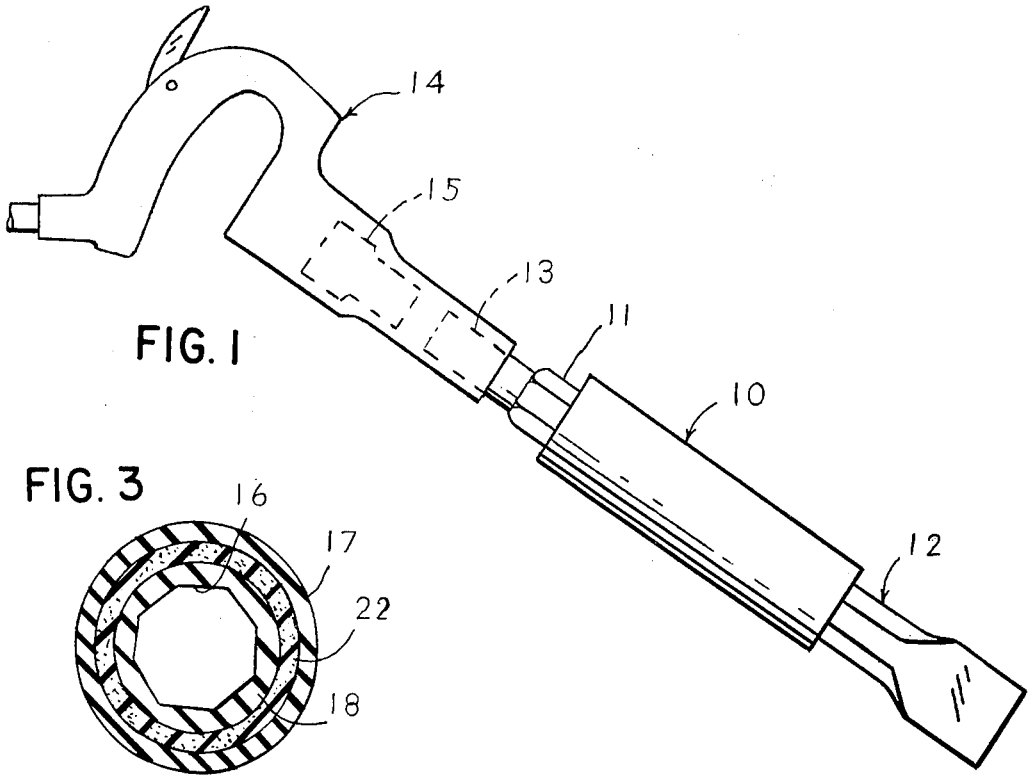
FIG. 1
FIG. 3
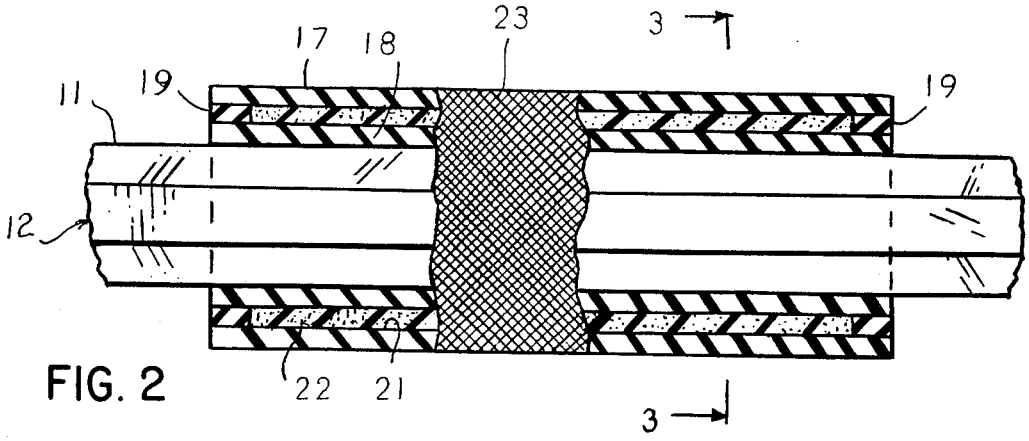
FIG. 2

VIBRATION ISOLATING HAND GRIP FOR SHANK OF A PERCUSSIVE CHISEL

BACKGROUND OF THE INVENTION

This invention relates to vibration isolators for percussive tools; and has for its object to provide a vibration isolator that may be supplied as a hand grip to the shank of the work element of such tools.

The invention is especially suited for use with percussive tools known as chipping hammers. In tools of this type a pneumatically powered piston hammer is rapidly reciprocated to repeatedly and forcefully strike a chisel against a work object. The tool is portable, and adapted to be hand held when used. An undesirable problem attenting the operation of such tools is created by the considerable vibration imparted to the chisel. This makes it difficult at times for the operator to maintain the working end of the chisel in contact or on target with the work.

Attempts have been made to solve this problem by providing the tool with an elongated slender housing so as to enable the operator to firmly hold the tool in both hand and thereby better steady it relative to the work. Some of the tools are formed with a pistol grip handle to be grasped in one hand while the operator grasps the barrel of the housing in the other to obtain a desired steadying of the work implement on its target.

Despite these attempts, further steadying of the tool against vibration and moving from the work is often required, especially where the target area of the work is small. The operator from experience has found that when necessary he can guide and steady the work implement relative to the work, even where the target area is small, by holding the handle firmly on one hand and grasping the shank of the chisel in the other. While this method of using the tool may provide desirable work results, it transmits considerably undesirably vibratory forces to the hand of the operator. These forces are a source of discomfort, and may be physically damaging to the operator's hand.

Accordingly, the general objective of this invention is to provide a vibration isolating hand grip or sleeve unit for the shank of the work implement or chisel, which may be grasped by the operator to guide and hold the chisel relative to the work without his receiving undesirable vibratory forces in his hand.

Besides the advantage of isolating the vibrations of the chisel from the operator's hand, the sleeve unit has other desirable advantages. It can be readily slipped on or off the shank of a chisel before insertion or after removal of the chisel from the tool. This advantage is of particular value especially in the removing of flashing from castings in foundries and in other operations where a number of chisels, each with a differently formed work tip, are successively used in a work operation. The sleeve may be readily slipped off one chisel, and then slipped onto the next to be used in such operations.

BRIEF DESCRIPTION OF THE DRAWINGS

In the accompanying drawing:

FIG. 1 is a picture view of a pneumatically powered chipping hammer in which a chisel has been inserted having a sleeve unit embodying the invention applied to its shank;

FIG. 2 is a side view, partly in longitudinal section, illustrating a first form of a sleeve unit embodying the invention;

FIG. 3 is a cross section taken on line 3—3 of FIG. 2;

FIG. 6 is a side view broken away in part illustrating the addition of a protective cap to an end of the sleeve unit; a similar cap not shown would be applied to the opposite end.

DETAILED DESCRIPTION OF THE INVENTION (FIGS. 1-3)

Figure 4:
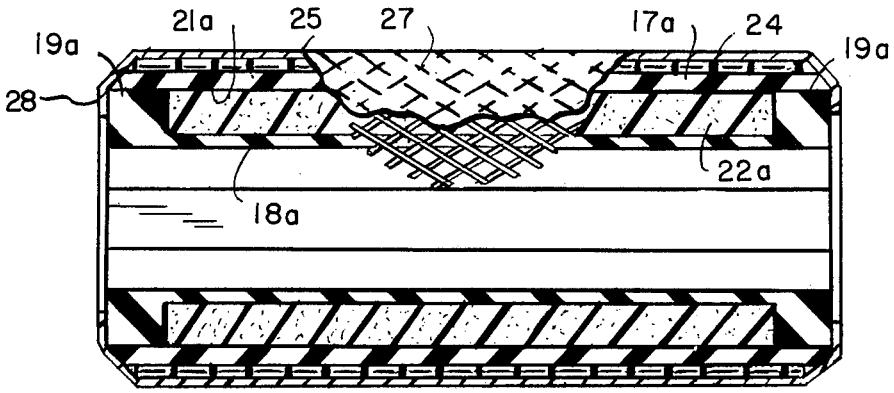
FIG. 4 is a side view, partly in longitudinal section of a further form which the sleeve unit may take.

Reference is now directed to the accompanying drawing, and now especially to FIGS. 1-3 in which a vibration isolating hand grip or sleeve unit 10 embodying the invention is illustrated as applied to the shank 11 of an impact receiving work element or chisel 12. The tail or rear anvil end 13 of the chisel is adapted to be slidably inserted into the front end of the housing of a conventional chipper hammer or like tool 14. When inserted into the tool, the chisel is in a position to be repeatedly and forcefully pounded against the work by a piston hammer 15 reciprocating at a high frequency.

The rapidly repeated striking of the piston against the chisel, and the chisel against the work develops considerable vibration in the chisel making it difficult for the operator to prevent the chisel from "walking" or moving from the work unless the chisel is restricted in some manner in this respect. The sleeve unit 10 is an advantageous solution to this problem. By grasping the sleeve unit in one hand and holding the tool in the other hand, the operator is enabled to check the "walking" action of the vibrating chisel and to hold the chisel in a desirable contacting position with the work. The sleeve unit functions to materially dampen and isolate the undesirable vibrations of the shank of the chisel from the hand of the operator.

The sleeve unit is of a suitable length enabling it to be comfortably graped in the palm of the operator's hand; and it is preferably long enough to protrude a little beyond opposite sides of the hand. The protruding portions of the sleeve provide a buffer to the operator's hand from coming in undesirable contact with the vibrating end of the housing or with the work.

The sleeve unit is, however, shorter than the usual elongated length of the shank of the chisel so as to allow the tail portion of the chisel to protrude sufficiently beyond the sleeve unit to be adequately inserted into the housing of the tool.

The sleeve unit is provided with an axially extending through hole 16 which enables the unit to be slidably moved or slipped down over the shank of the chisel, or to be slipped free of the latter. The hole is preferably of a configuration, in cross section, conforming to that of the shank of the chisel; that is, it is polygonal for multisided shanks, as in FIG. 3; and is circular for round shanks.

The sleeve unit comprises a pair of coaxially arranged elastometric sleeves 17 and 18, held in radially spaced relation to each other by means of a pair of annular elastomeric spacers 19. One of the spacers is located between the sleeves at one end of the latter; and the other spacer is similarly located at the other end, whereby an annular cavity or space 21 is defined between the sleeves. This cavity is filled with fluent material, which is illustrated here as a soft resilient material 22, such as foam rubber.

The spacers are cemented or bonded to the opposed contacting surfaces of the sleeves, whereby a unitary or one-piece sleeve structure or unit is obtained.

The elastomeric material forming the spacers and sleeves, while being firm or stiff enough to maintain a normal straight or erect form for the unit, is sufficiently soft enough to enable the unit to be manually squeezed with an application of light pressure.

In the operation of inserting the chisel into the housing of the tool after the sleeve unit has been applied to the chisel, the operator, while holding the tool in one hand, graps the unit in his other hand. Upon manually squeezing the unit, the pressure is translated from the outer sleeve, the radial spacers, and foam rubber to deform the inner sleeve into a firm gripping relation with the shank of the chisel. A light manual squeezing pressure will ordinarily suffice to obtain this result. While still holding and squeezing the unit, the operator can insert the protruding tail end of the shank into the housing of the tool. The operator may, after relaxing the pressure of his hand from the unit, slidably adjust the latter as needed along the shank.

It has been found that use of the sleeve unit provides a desirable degree of shank vibration damping and isolation without undesirable effects upon the operator, when the unit is manually held by the operator during operation of the tool.

The outer sleeve 17 of the sleeve unit is shown in FIG. 2 as having a knurled surface 23. While the softness of the outer sleeve provides good hand grasping characteristics, the knurls serve to increase these characteristics.

The material within the cavity 21, together with the spacers 19, provides a means of converting the lightly pressured grip of the operator on the outer sleeve 17 to a firm grip of the inside sleeve 18 with the shank 11 of the chisel.

When using a soft elastomer material of 40–50 Shore A grade for the sleeves and spacers, and in using soft resilient foam materials of 45–60 pores per inch of for the cavity filling, good results are obtained in the use of the sleeve unit.

It has been found that liquid, such as water, may be substituted with good results for the foam rubber 22 in the annular cavity 21 between the inner and outer tubes. But when a liquid is used, it is required that a good fluid tight seal be provided by the spacers 19 at the ends of the cavity.

FIG. 4 FORM

In the FIG. 4 form of the sleeve unit opposite end portions of the inner sleeve **18*a* have been radially enlarged so as to provide an integral 1 and or spacer rib 19*a* about each end of the sleeve. In effect the spacers 19 and inner sleeve 18 shown in FIG. 2 have now been combined in FIG. 4 into an integral one-piece sleeve 18*a***. This is of advantage in that it reduces the number of components of the unit and accordingly facilitates its assembly.

The outer sleeve **17*a* rests at its ends upon the surface of the ribs 19*a*, and is preferably bonded to them. The resultant annular cavity or space 21*a* defined between the sleeve is filled with the soft material 22*a***.

To further enhance the vibration damping and gripping characteristics of the unit, a ribbed netting 24 of suitable stiff but flexible material, such as plastics, is wrapped around the outer sleeve **17*a* and is covered with a tightly fitting jacket 25 of thin elastomer. The netting is extended over the outer sleeve so that its ends will be positioned above the spacer ribs 19*a***.

The ribbed characteristics of the netting are translated to the tightly fitting thin jacket, whereby the latter is provided with a quasi-knurled surface 27 that enables a good non-slipping grip to the operator's hand with a desirable degree of comfort.

The longitudinal stiffness afforded by the jacket and netting together with their extended position above the spacer ribs **19*a* at opposite ends of the sleeve unit serves to provide a further degree of ioslation of the operator's hand from the vibrations of the tool. The jacket and netting arrangement also serves to spread the finger squeeze of the operator's hand over a greater area of the outer sleeve and, as a consequence, to a corresponding degree through the soft fluent material 22*a*** to the inner sleeve, whereby a desirable uniform gripping of the sleeve unit over a wide area with the shank is provided.

FIG. 5 FORM

Figure 5:
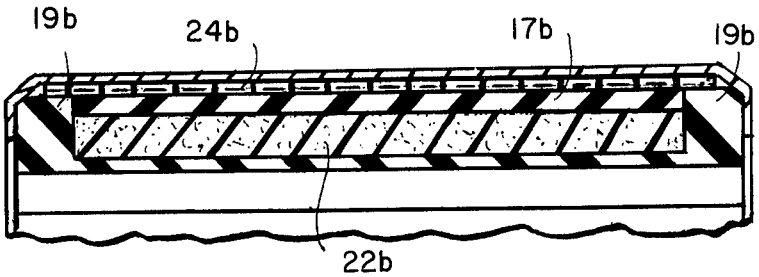
FIG. 5 is a fragmentary section of a sleeve unit differing slightly in construction from that of FIG. 4.

The form of the sleeve unit shown in FIG. 5 is similar to that of FIG. 4, except that the spacer ribs **19*b* have been radially increased in diameter so as to abut against the underside of the end portions of the ribbed netting 24*b*; and the outer sleeve 17*b* has been shortened so as to fit between the spacer ribs 19*b* and in overlying relation to the soft material 22*b***.

A particular advantage of this form of the unit is that it is not necessary to bond the sleeve elements to one anther, thus serving to facilitate assembly of the sleeve

FIG. 6 FORM

In the FIG. 6 form of the sleeve unit the thin elastomer jacket **25*c* tightly covers the ribbed netting 24*c*, but does not extend beyond and in backing relation to the ends of the unit in the manner indicated at 28 by the jacket 25 in FIG. 4. Instead, a thin elastic cap 26 in the form of an elastomer band is fitted over each end of the jacket so as to protectively cover the ends of both the jacekt and netting, only one of the caps being shown. The outer sleeve is indicated at 17**.

We claim:

1. A sleeve unit adapted to be applied to the shank of a work element of a perspective tool and adapted to be grasped in the palm of a worker's hand during operation of the tool, the sleeve unit comprising an enlongated cylindrical body formed of manually squeezable resilient material, the body having an axially extending through hole adapted to receive slidably the shank of a percussive work element, the body having an elongated annular or closed cavity therein, and fluent material filling the cavity, said body comprising a cylindrical outer sleeve of elastomeric material, a cylindrical inner sleeve of elastomeric material disposed in coaxial relation to the outer sleeve, an annular elastomeric spaced disposed between the sleeves at one end of the unit, a second annular spacer disposed between the sleeves at the opposite end of the unit, the spacers serving the space the outer sleeve radially from the inner sleeve, the spacers defining a closed annular cavity between the sleeves containing the fluent material, the spacers being bonded to the inner and outer sleeves, and the inner sleeves defining the axial through hole.

2. A sleeve unit as in claim 1, wherein the outer sleeve has a knurled outer surface.

3. A sleeve unit as in claim 1, wherein a ribbed netting of flexible material surrounds the outer sleeve.

4. A sleeve unit as in claim 3, wherein the ends of the netting are located above the spacers.

5. A sleeve unit as in claim 3, wherein a thin elastomer jacket tightly covers over the netting.

6. A sleeve unit as in claim 1, wherein the inner sleeve and the corresponding end spacers are integral to define a one-piece element.

7. A sleeve unit as in claim 2, wherein the end spacers a are radially enlarged to abut corresponding underside areas of the netting, and the outer sleeve is disposed between the spacers in overlying relation to the fluent material.

* * * * *